US009174709B2

(12) United States Patent
Ekstedt

(10) Patent No.: US 9,174,709 B2
(45) Date of Patent: Nov. 3, 2015

(54) ARRANGEMENTS FOR WINDSURFING

(76) Inventor: Johan Ekstedt, Grillby (SE)

( * ) Notice: Subject to any disclaimer, the term of this patent is extended or adjusted under 35 U.S.C. 154(b) by 0 days.

(21) Appl. No.: 14/130,376

(22) PCT Filed: Jun. 18, 2012

(86) PCT No.: PCT/SE2012/050666

§ 371 (c)(1),
(2), (4) Date: Dec. 31, 2013

(87) PCT Pub. No.: WO2013/006120

PCT Pub. Date: Jan. 10, 2013

(65) Prior Publication Data

US 2014/0196649 A1 Jul. 17, 2014

(30) Foreign Application Priority Data

Jul. 1, 2011 (SE) ..... 1100513

(51) Int. Cl.
*B63H 9/00* (2006.01)
*B63B 35/79* (2006.01)
*B63H 9/06* (2006.01)

(52) U.S. Cl.
CPC ..... *B63B 35/7906* (2013.01); *B63B 35/7916* (2013.01); *B63B 35/7983* (2013.01); *B63H 9/0657* (2013.01); *B63B 35/7926* (2013.01)

(58) Field of Classification Search
CPC B63B 35/79; B63B 35/7906; B63B 35/7916; B63B 35/7926; B63B 35/7983; B63B 9/0657
USPC ..... 114/39.12, 39.14, 39.15
See application file for complete search history.

(56) References Cited

U.S. PATENT DOCUMENTS

| | | | | |
|---|---|---|---|---|
| 3,996,868 | A * | 12/1976 | Schagen | 114/39.14 |
| 4,100,870 | A | 7/1978 | Prade | |
| 4,807,549 | A * | 2/1989 | Rhodes et al. | 114/39.14 |
| 7,121,909 | B1 * | 10/2006 | Meyerhoffer | 441/74 |
| 7,740,512 | B1 | 6/2010 | Patterson | |

FOREIGN PATENT DOCUMENTS

| | | | |
|---|---|---|---|
| CA | 1142799 | | 3/1983 |
| CN | 201140782 | Y | 10/2008 |
| DE | 3216976 | A1 | 11/1983 |
| DE | 10145806 | | 4/2003 |
| EP | 52783 | | 6/1982 |
| EP | 111987 | | 6/1984 |
| FR | 2549442 | | 1/1985 |
| FR | 2699139 | | 6/1994 |
| GB | 2413991 | A | 11/2005 |

* cited by examiner

*Primary Examiner* — Daniel V Venne
(74) *Attorney, Agent, or Firm* — Dilworth & Barrese, LLP

(57) ABSTRACT

Tills disclosure relates to a windsurfing board kit (100) for assembling windsurfing boards of different types. In light winds a relatively large windsurfing board is suitable, whereas in strong wind conditions a smaller windsurfing board is suitable, in addition, in fight winds a relatively large sail is suitable, whereas a relatively small sail is suitable in strong wind conditions, in light winds a relatively large board with a centerboard fin is suitable, whereas in strong wind conditions a smaller board without a centerboard fin is suitable. This disclosure enables assembling windsurfing boards of different sizes and different types. In addition, the disclosure enables adjusting the sail area of a sail for lire type of windsurfing board.

16 Claims, 9 Drawing Sheets

ARRANGEMENTS FOR WINDSURFING

TECHNICAL FIELD

This disclosure pertains in general to the field of surfing, and more particularly to arrangements for windsurfing.

BACKGROUND

Windsurfing by using a board for windsurfing may be performed in light winds as well as in strong winds. Typically a windsurfing board that is suitable for light winds, is not well suited for strong winds. Also, a windsurfing board that is suited for strong winds is not well suited for windsurfing in light winds. The reasons will be explained in down below.

A windsurfing board typically comprises a board itself as well as a rig, comprising at least a mast and a sail, where a foot of the mast is designed to meet the board in a mast box.

A light wind windsurfing board typically has a relatively large board and a sail with a relatively large sail area. The light wind windsurfing board has a centerboard and a tail fin. On the other hand, a strong wind windsurfing board typically has a relatively small board and a sail with a relatively small sail area. It is advantages that the weight of the strong wind windsurfing board is as low as possible and that the bottom side or the so called "wet surface", i.e. the surface that slides against the water, is as smooth as possible to reduce friction between the strong wind windsurfing board and the water. The strong wind windsurfing board has a tail fin but requires no centerboard fin. It is actually hindered by any centerboard fin.

In strong winds smaller windsurfing boards are preferably surfed with fin planning, i.e. they are sailed in planning when lying in a relatively high position in the water due to the water's surface tension.

Lying in a relatively high position in the water reduces the friction between a planning windsurfing board and the water. The resistance against a planning windsurfing board by the water is thus reduced. The reduced resistance can be translated into an increased forward driving force.

Due to the wind, a sideways drifting force is exerted on the windsurfing board. The sideways drifting force, in relation to the forward driving force, is therefore lower.

A fin planning windsurfing board can be sailed with one fin at the tail of the windsurfing board, a so called tail fin, which tail fin sufficiently reduces sideways drifting forces in strong winds.

In light wind conditions a larger windsurfing board lie in a relatively low position in the water and is sailed in non-planning by using the center board fin to reduce sideways drifting. Since the light wind windsurfing boards are larger than the strong wind windsurfing boards, they are heavier, and since they have a centerboard and a centerboard box for the centerboard fin, they show a higher resistance against the water relative strong wind windsurfing boards without a centerboard and a centerboard box.

Without centerboard box for the strong wind windsurfing boards, the resistance against the water as compared to the light wind windsurfing boards having a centerboard box, is reduced and therefore lends the strong wind windsurfing boards improved sailing properties in planning conditions.

A centerboard box in a windsurfing board increases the resistance against the water for said windsurfing board. The bottom of a strong wind windsurfing is therefore made smooth without a centerboard box. A relatively low resistance windsurfing board hence lends said windsurfing board relatively good sailing properties in planning conditions. In addition, a centerboard in a windsurfing board also increases the weight of the windsurfing board due to the weight of the centerboard and the centerboard fin box. There is thus another advantage not use a centerboard in a strong wind windsurfing board.

A light windsurfing board can not be planning in the water in light winds, whereas a strong windsurfing board is designed for planning in the water in strong winds. Needless to say, windsurfing is to a large extent dependent on the windsurfing skill of the person that is windsurfing, for which reason light winds are better suited for beginners, whereas strong winds mainly attract persons already skilled in the art of windsurfing.

Dependent on the wind and the surfer's surfing skills a variety of windsurfing boards are needed. Having a variety of wind surfing boards may be a transportation and storage challenge, since each board consumes substantial space.

The patent application EP0052783 A1 discloses a windsurfing board comprising a first portion and a second portion, wherein the first portion comprises a centerboard and the second portion comprises a fin at the tail of said second portion. The second portion is rotatable in relation to the first portion, providing the windsurfing board with two alternative bottom shapes of the second portion when lying in the water.

From DE101145806 it is known to improve the gliding properties of a windsurfing board, for instance, by providing cut-outs from the tail at the bottom side of the windsurfing board.

There is thus a need for an alternative windsurfing board by which the transportation and storage challenge is essentially solved.

SUMMARY

An object of the present disclosure is to address at least some of the issues outlined above, and to provide a windsurfing board that is easily adaptable according to surfing conditions and/or to the skill of the surfer.

This is attained by providing a windsurfing board kit for assembling different types of windsurfing boards.

In addition, the size of a sail of the windsurfing boards may be adapted to suit the preferences of a surfer at certain wind or weather conditions.

According to one aspect of the present disclosure a windsurfing board kit for assembling different types of windsurfing boards is provided. The windsurfing board kit comprises a first portion comprising a first bottom side, and a first tail fin provided on said first bottom side, and a second portion comprising a second bottom side and a second fin provided on said second bottom side. The second portion is removably connectable to the first portion.

The first portion constitutes a first windsurfing board suitable for strong winds and the first portion connected to the second portion constitutes a second windsurfing board suitable for light winds and in which second windsurfing board the first tail fin acts as a center board of the second windsurfing board and the second fin acts as a tail fin of the second windsurfing board.

The second windsurfing board of the windsurfing board kit may have a bottom side that is formed by the entire or essentially the entire first bottom side of the first portion and the entire or essentially the entire second bottom side of the second portion, when the first portion is connected to the second portion.

The first portion of the windsurfing board kit may have at least one cut-out from the bottom side at the tail of said first portion.

The second portion of the windsurfing board kit may have a protruding element that is protruding from the second portion, wherein said protruding element is configured to meet a cut-out of the first portion, when the second portion is connected to the first portion.

The second portion of the windsurfing board kit may have a protruding means that is configured to meet a recess in the rear of the tail of the first portion, the recess being directed essentially along, or at least parallel with, a centerline "A" of the second portion.

The first portion of the windsurfing board kit may comprise a base portion comprising a third bottom side, a side rail and a first tail fin provided at said third bottom side, and one or two elongated side portions that are removably connectable to the base portion along at least one side rail. The base portion constitutes a third windsurfing board suitable for very strong winds.

The windsurfing board kit may further comprise a sail that is configured for a windsurfing board. The sail comprises a first sail portion that has a mast sleeve, a rear leech, and one or more first batten pockets, and a second sail portion that has a front leech, a rear leech and one or more second batten pockets, where the second sail portion is removably connectable to the first sail portion by one or more fastening means, wherein said one or more second batten pockets are arranged to correspond to said one or more first batten pockets, enabling each first and second batten pocket to meet a first and a second end, respectively of a batten.

The second sail portion of the windsurfing board kit may be connected to the first sail portion, wherein the sail further comprises one or more battens of which one end of each one or more battens is inserted into one of the first batten pockets, and the other end of each one or more is inserted into one of the second batten pockets, and where one or more battens are directed essentially perpendicular to the rear leech of the first sail portion as well as to the front leech of the second sail portion.

The rear leech of the second sail portion of the windsurfing board kit, may end at a clew of the first sail portion, when the first sail portion is connected to the second sail portion.

By providing a windsurfing kit from which three different windsurfing boards can reversibly be formed, and two different windsurfing sails, it is enabled to tailor the choice of windsurfing board according to weather conditions and the surfing skills.

In addition, a further advantage of embodiments of the present disclosure is that the windsurfing kit saves space and transportation cost, as compared to up to six separate complete surfing boards, and may therefore be considered to be a green alternative to a variety of windsurfing boards.

BRIEF DESCRIPTION OF DRAWINGS

These and other aspects, features and advantages of which this disclosure is capable of, will be apparent and elucidated from the following description of embodiments of this disclosure, reference being made to the accompanying drawings, in which.

DETAILED DESCRIPTION

According to a basic concept of this disclosure, a strong wind windsurfing board is converted to a centerboard windsurfing board suitable for light winds.

Figure 1:
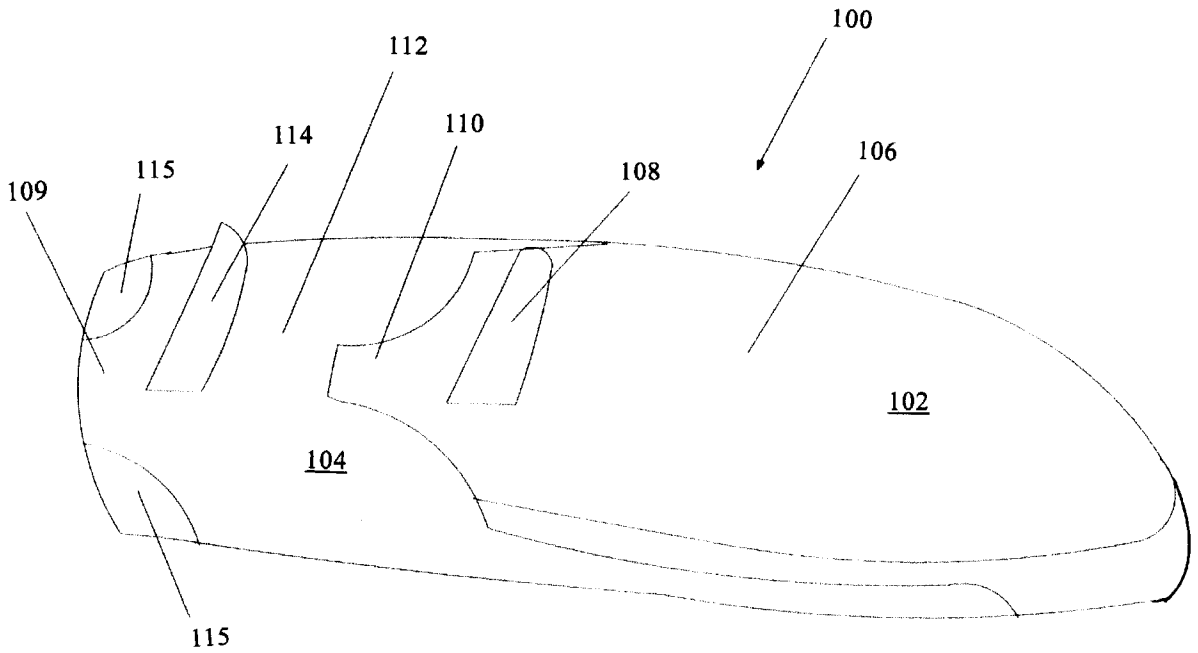
FIGS. 1-6 illustrate aspects of a windsurfing board kit according embodiments of the present disclosure.

FIG. 1 schematically presents a bottom-side view of a first windsurfing board 100 of a windsurfing board kit, according to embodiments of the present disclosure. The windsurfing board kit is suitable for assembling different types of windsurfing boards.

The first windsurfing board kit 100 comprises

- a first portion 102 comprising a first bottom side 106 and a first tail fin 108 provided on said first bottom side, and
- a second portion 104 comprising a second bottom side 112 and a second fin 114 provided on said second bottom side 112. The second portion 104 is removably connectable to said first portion 102.

The first portion 102 constitutes a first windsurfing board that is suitable for strong winds. The first portion connected to the second portion 104 constitutes a second windsurfing board that is suitable for light winds. Within the second windsurfing board, the first tail fin 108 acts as a center board of the second windsurfing board and the second fin acts as a tail fin of the second windsurfing board.

The first tail fin 108 may protrude from the bottom side 106 of the first portion 102, whereas the second fin 114 may protrude from the bottom side 112 of the second portion 104, in the second windsurfing board 100.

FIG. 1 schematically illustrates that the first tail fin 108 and the second fin 114 are directed perpendicular to the bottom side 106, 112 of the first portion 102 and the second portion 104, respectively. It is also illustrated cut-outs 115 from the second portion at the tail of said second portion.

It is also illustrated that the first tail fin 108 and the second fin 114 are provided separated from each other at a distance along an elongation axis of the windsurfing board.

The first windsurfing board of the windsurfing board kit 100 is typically a fin planning windsurfing board having a single fin-box for said first tail fin 108 at the tail 110 on the bottom side 106 of the first windsurfing board 102.

The second windsurfing board of the windsurfing board kit is typically a displacement type of windsurfing board, when the first portion 102 is connected to said second portion 102.

The bottom side of the second windsurfing board may be formed by the entire or essentially the entire bottom side 106 of the first windsurfing board 102 and the entire or essentially the entire bottom side 112 of the second portion 104, when the second portion 104 is connected to said first portion 102.

The bottom side of the second windsurfing board may thus comprise at least a substantial part of the bottom side 106 of the first windsurfing board 102 and at least a substantial part of the bottom side 112 of the second portion 104.

In addition, the bottom side 106 of the first windsurfing board formed by the first portion 102 has a bottom shape.

Figure 2:
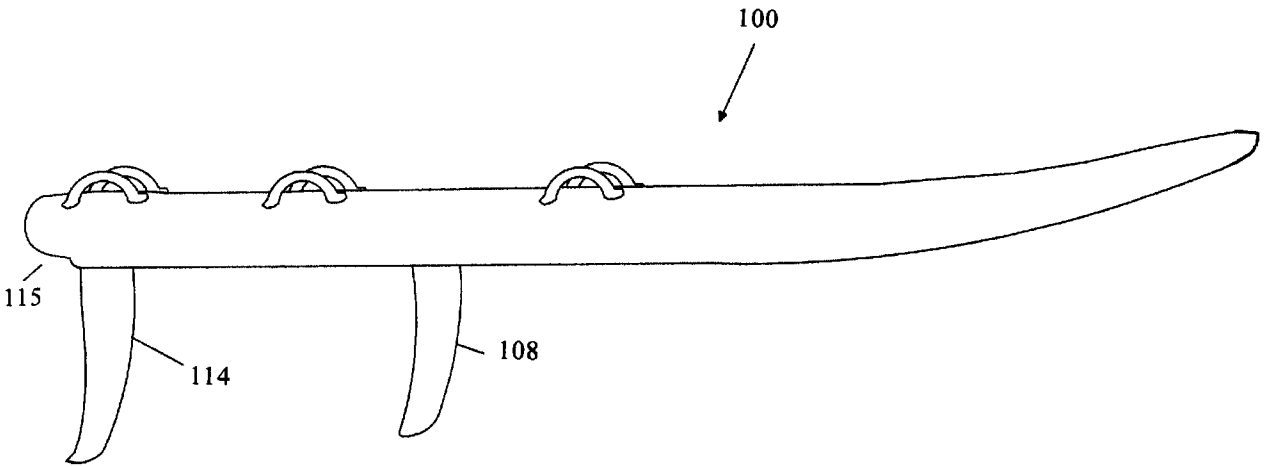

FIG. 2 is a side-view of a windsurfing board kit 100 where the first portion 102 and the second portion 104 are connected to each other, forming the second windsurfing board. The first tail fin 108 of the first portion is directed perpendicular to the bottom side of the first portion. The second fin 114 of the second portion is directed perpendicular to the bottom side of the second portion.

FIG. 2 also depicts a cut-out 115 of the second windsurfing board of the windsurfing board kit 100.

Figure 3:
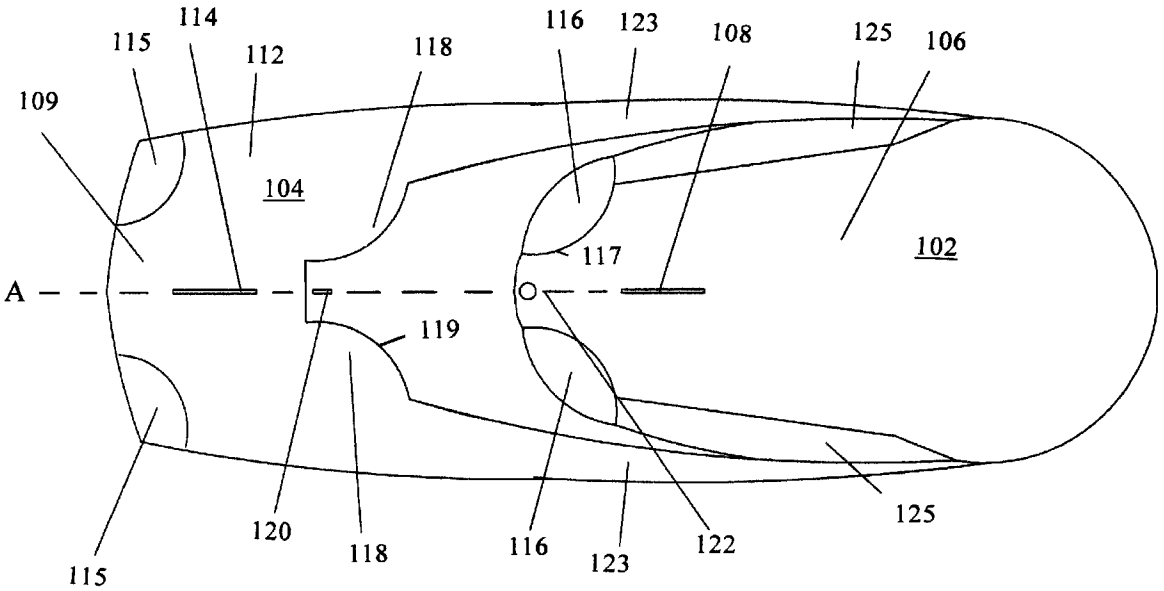

FIG. 3 schematically presents a bottom view of the windsurfing board kit 100, according to embodiments of the present disclosure, where the second portion 104 of the windsurfing board kit 100 is separated from the first portion 102 of said windsurfing board kit.

The first portion 102 comprises the first tail fin 108 directed perpendicularly to the bottom side 106 of the first portion 102, and on this FIG. 3 protrude out of the paper sheet/screen of the reader. Said first portion 102 also comprises a cut-out 116 from the bottom side 106 of said first portion 102.

As indicated in FIG. 3, the second portion 104 comprises the second fin 114 being directed perpendicularly to the bottom side 112 of the second portion 104, and on this FIG. 3 protrudes towards the reader of this disclosure.

The second portion 104 may comprise a protruding element 118 that is configured to meet a cut-out 116 of the first portion 102, when the second portion 104 is connected to the first portion 102. The protruding element 118 has an outer rim 119 that can be adapted to meet an inner rim 117 of the cut-out 116 of the first portion 102 of the windsurfing board kit 100, when the first 102 and second 104 portion are connected to each other.

The second portion 102 may also comprise protruding means 120 that configured to meet a recess in the rear of the tail 110 of the first portion 102, where the recess is directed essentially along, or at least parallel with, a centerline (A) of the second portion 104. The centerline is a elongation line of the second portion 104. When connecting the second portion 104 onto the first portion 102, the protruding means 120 therefore fits into a recession of the tail of the first portion 102.

The protruding means 120 may be a tubular in shape, and for instance be a metal tube. The recession in the first portion 102 may be a tubular hole with a depth that corresponds to the length of the protruding means 120.

Needless to say the protruding means 120 and the recession may have a cross section with a shape different from tubular, such as square or any other polygonal form.

FIG. 3 also illustrates cut-outs 115 from the bottom side 112 of the second portion 104.

In addition, the shape of the second portion as seen from below, for instance as bottom view of FIG. 3, is reminiscent of a U-shaped form. Whereas the rear part (as presented to the left in FIG. 3) corresponds to a base of a "U", elongated members 123 correspond to the sticks of the "U". When connecting the second portion 104 to the first portion 102 an inner face 126 of each elongated member 123 contacts the side rail 125 of the first portion 102.

By mounting each end of the elongated member 123 into each side rail 125, the second portion 104 is connected to the first portion 102. Needless to say mounting made be performed in many different ways.

The cut-outs 116 as well as the protruding means 120, in tight collaboration with protruding elements 118 and the recession (not shown) orient the second portion 104 in position to the first portion 102 when connected and prevent lateral movements of the second portion 104 relative to the first portion 102.

Lateral movement are herein understood as movements perpendicular to the bottom side, or top side, of a windsurfing board.

Figure 4:
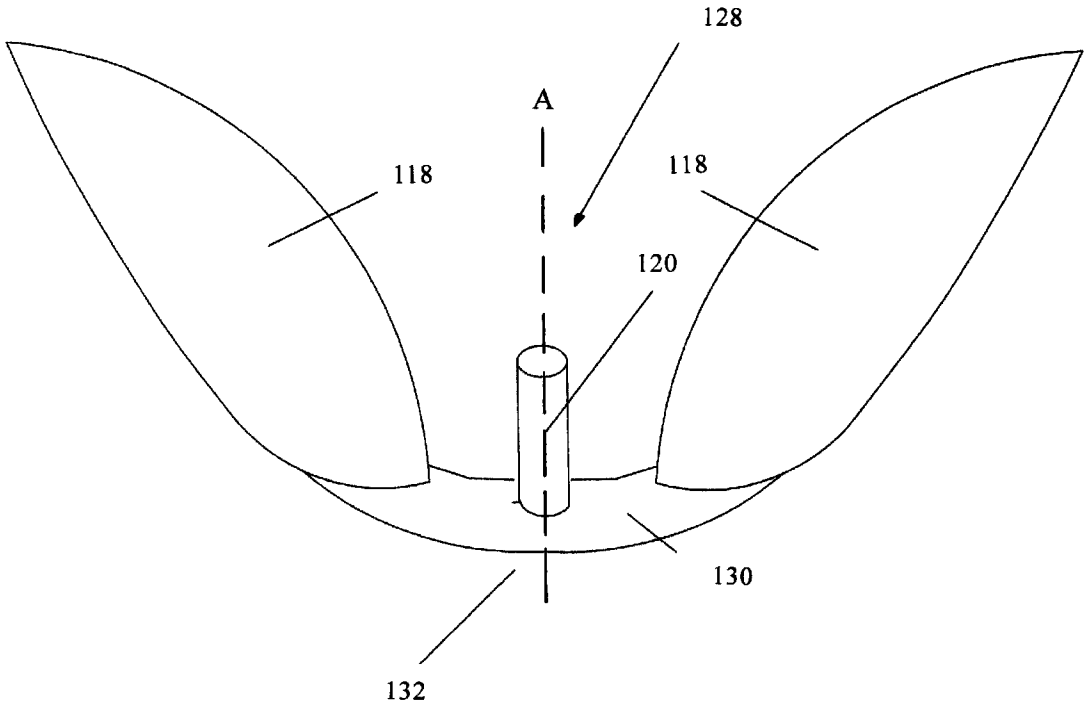

In the following, the protruding elements 118 of the second portion 104 will be described in some detail. FIG. 4 illustrates a zoom-in of one part 128 of the second portion 104, and hence presents a cut-down partition of said second portion 104. In FIG. 4 two protruding elements 118 are shown. These protruding elements 118 meet and interact with the cut-outs of the first portion 102, when the first portion 102 is connected to the second portion 104.

The protruding elements 118 protrude from a front face 130 of the second portion 104, in a direction along and towards a longitudinal center line A, of FIG. 4, of the second portion 104. Moreover, the protruding element 120 protrudes from the front face 130 along the longitudinal center line A.

The reference numeral 132 denotes a top side of the second portion.

Figure 5:
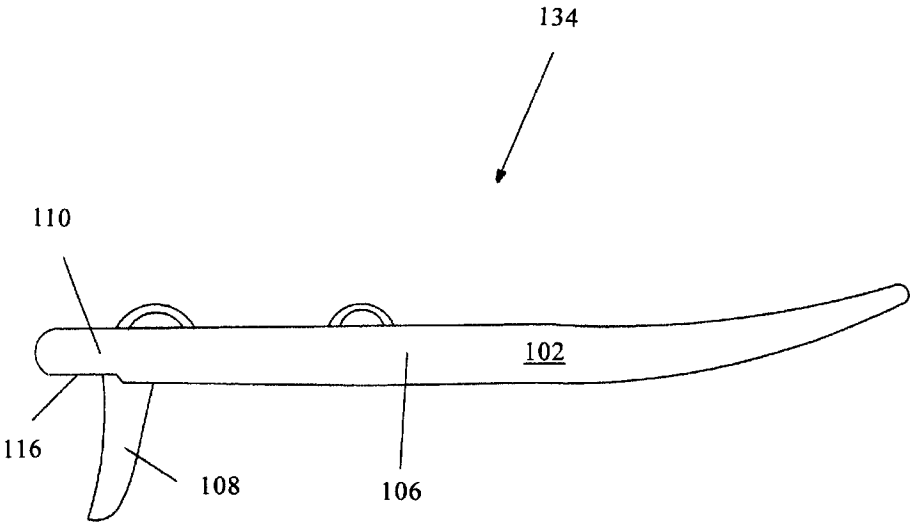

As mentioned above, the first portion 102 constitutes a first windsurfing board on its own, which is suitable for strong winds, i.e. without having the second portion 104 connected to the first portion 102. FIG. 5 is a side-view of the first portion 102 of this first windsurfing board that is suitable for strong winds.

It is illustrated that the first tail fin 108 is directed perpendicular from the bottom side 106 of this first windsurfing board 134. In addition, at the tail 110 of said first windsurfing board 134 a cut-out 116 from the bottom side 106 is presented.

It is noted that this first windsurfing board has a first tail fin 108 at the tail only of the surfing board. This is in contrast to the second windsurfing board as presented above which second windsurfing board is suitable for light winds.

The second windsurfing board constitutes of the first portion 102 when being connected to the second portion 104. The first tail fin 108 of the first portion acts as a center board of the second windsurfing board and the second fin 114 of the second portion 104 acts as a tail fin of the second windsurfing board. The second fin 114 is thus positioned at the tail 122 of said second windsurfing board, whereas the first tail fin 108 is positioned further towards the front of the second windsurfing board, acting as a centerboard.

The first tail fin 108 of the first portion 102 is hereby given the function of a centerboard for the second windsurfing board. A centerboard is suitable for windsurfing boards that are relatively large and for light wind conditions, as surfing without a centerboard in light winds easily results in an undesired course deviation.

Since the first windsurfing board as presented in FIG. 5 does not have the second portion connected it, it is smaller than the second windsurfing board, and hence is suited for strong winds, whereas the second surfing board is suited for light winds. In strong winds there is no need for a centerboard, since the first tail fin 108 can stabilize the direction of the first windsurfing board at high forward speeds. How to manage a windsurfing board in various winds is off the scope of the present disclosure, and will hence not be discussed further.

In conditions of even stronger winds, it may be desired to have a windsurfing board that is even smaller than the first windsurfing board 134 of the first portion 102. For this reason, a third windsurfing board can be assembled from the windsurfing board kit.

The first portion 102 may comprise a base portion 138 that comprises a third bottom side 139, a side rail 143 and the first tail fin 108 provided on said third bottom side, and one or two elongated side portions 140 that are removably connectable to the base portion 138 along said side rail 143. The base portion 138 constitutes a third windsurfing board suitable for very strong winds.

Figure 6:
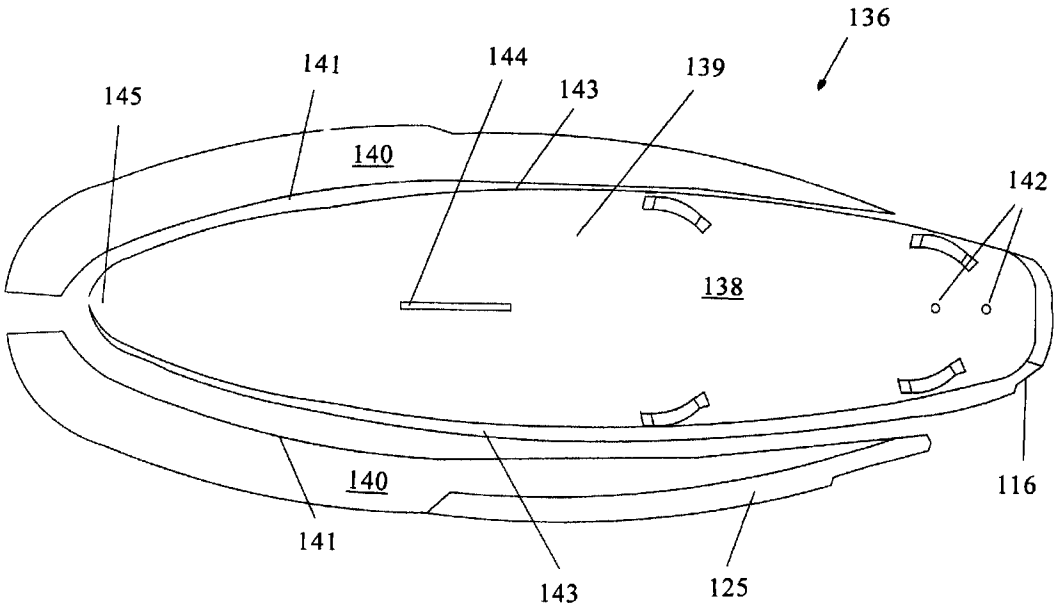

FIG. 6 presents the first portion 102 comprising said base portion 138 and one or two elongated side portions 140 that are removably connectable to the base portion 138. The one or two elongated side portions 140 have an inner surface 141 that is configured to meet and align along side rails 143 of the base portion 138.

Again, the base portion 138 constitutes the third windsurfing board that is suitable for even stronger winds than the second windsurfing board is suitable for. The first tail fin 108 of the first portion forms a tail fin of the base portion 138 of the third windsurfing board.

The elongated side portions 140 may have essentially the same length, along an elongation axis of the base portion, as the base portion 138 itself. Alternatively, the one or more elongated side portions 140 may have a length different from, for instance shorter than, the base portion. In this case the elongated side portions 140 may be aligned along the side rails from a position substantially different from a front end 145 of the base portion 138, and to a position essentially at the tail of the base portion 138.

As presented earlier, FIG. 6 also depicts one of the cut-outs 116 at the tail of the base portion 138.

FIG. 6 presenting a top-side view of the surfing board 136, also presents arrangements 142 for fastening of the first tail fin 108 to the base portion 138 of the first portion 102. These arrangements may be formed by cylindrical through holes in the base portion 138.

If the base portion 138 is used on its own without the elongated side portions 140 connected to said base portion 138, the first tail fin 108 forms acts a tail fin of the base portion and therefore also of the third windsurfing board.

If the base portion 138 is connected to the elongated side portions 140, the first tail fin 108 acts a tail fin of the first portion, and therefore also the first windsurfing board.

It is also mentioned that the recess into the rear of the first portion 102, which recess is configured to meet a protruding means 120, is in fact a recess into the base portion 138. The base portion 138 is a major and central part of the first portion 102. This has the advantage that the second portion 104 is connected to the major and central part of the first portion when connecting said second portion 104 to the first portion 102 and building the second windsurfing board. The second portion 104 is therefore well stabilized in relation to the first portion 102 when connecting them together forming the second windsurfing board.

It is also noted that FIG. 6 schematically presents a mast box 144 for fastening a mast with a sail, for forming a windsurfing board comprising a sail.

Figure 7:
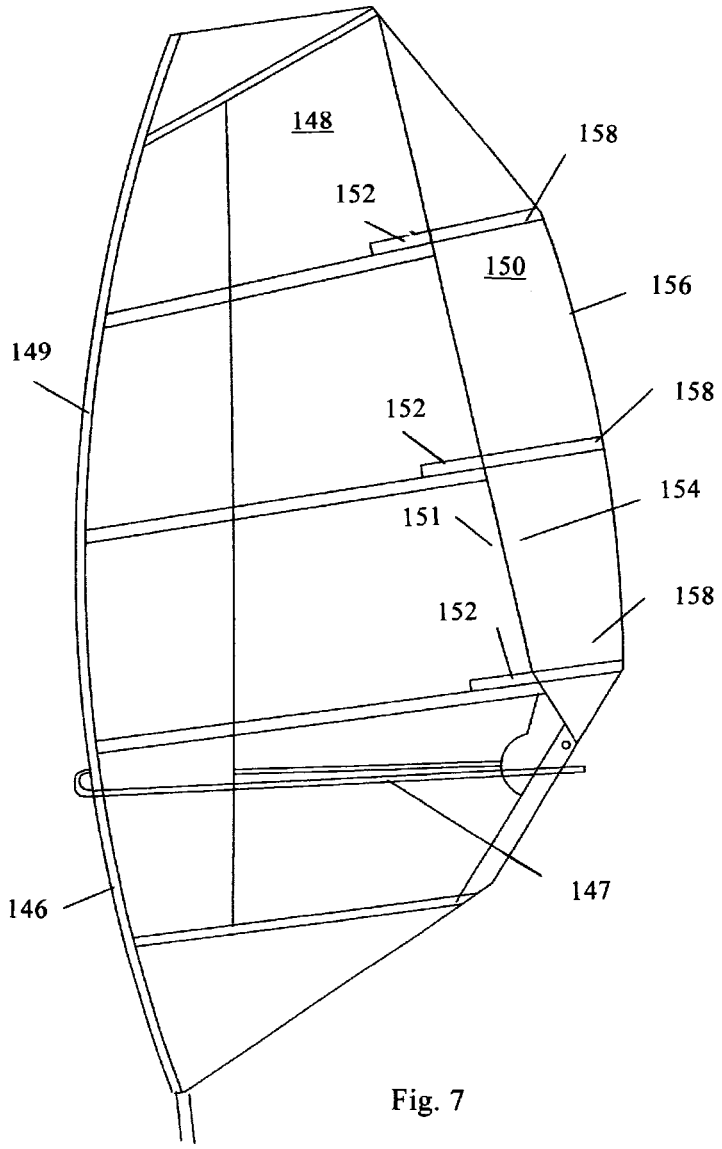
FIGS. 7 and 8 illustrate aspects of a sail according to embodiments of the present disclosure.

FIG. 7 presents a rig for a windsurfing board related to embodiments of the present disclosure. The rig comprises a mast 146, a boom 147 and a sail, which sail will be further presented down below.

The sail for a windsurfing board, according to embodiments of the present disclosure, may advantageously be combined with any one of the windsurfing boards as presented above, i.e. the first, second or third windsurfing board. The sail comprises a first sail portion 148 having a mast sleeve 149, a rear leech 151, and one or more first batten pockets 152, and a second sail portion 150, having a front leech 154, a rear leech 156 and one or more second batten pockets 158, where the second sail portion 150 is removably connectable to the first sail portion 148 by one or more fastening means, wherein said one or more second batten pockets 158 are arranged to correspond to said one or more first batten pockets 152, enabling each first and second batten pocket to meet a first and a second end, respectively, of a batten.

Figure 8:
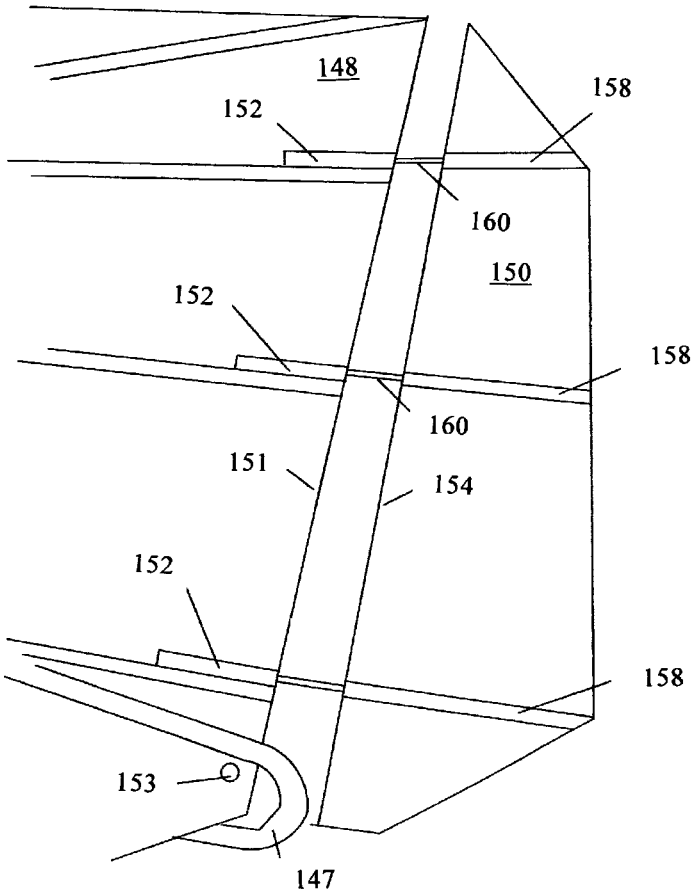

FIG. 8 presents a zoom-in of the second sail portion 150, comprising second batten pockets 158. In each of these second batten pockets 158 one end of a batten 160 may be inserted. Another end, opposite to the one end, of each batten 160 may be inserted into a first batten pocket 152 positioned at a location of the sail 148 which location corresponds to the one of the second batten pockets 158 of the second sail portion 150, for one and the same batten 160.

The fastening means for fastening the rear leech 151 of the first sail portion 148 to front leech 154 of the second sail portion 150 may comprise one or more means of the group comprising zipper, buttons and Velcro© fastening means.

It should be mentioned that the second sail portion 150 for a windsurfing board is configured to be removably connectable to a first sailing portion 148. When being connected, the front leech 154 of the second sail portion 150 essentially aligns along the rear leech 151 of the first sail portion 148. For this reason, the front leech 154 of the second sail portion 150 has its one end near a clew 153 of the first sail portion 148, at which the first sail portion may be tightened to the boom 147. For the reason that the second sail portion 150 does not require a different boom length, the same boom length may be preferably used when having a rig with the first sail portion, and a rig having the first and the second sail portion. Needless to say the same boom tension may be used as well.

It is also advantageous that since the foot of the sail is not used for connecting an additional sail, the same mast foot is preferably used for the two different sail settings as described above.

Since the second sail portion is removably connectable to the rear leech of the first sail portion, the same downhaul tension may be preferably be used for the two different sail settings of which includes the second sail portion, and the other does not include said second sail portion.

It may be pointed out that the rear leech 151 of the first sail portion 148 typically runs from the top of the first sail portion 148 down to the clew 153 of said first sail portion.

The present disclosure has presented a windsurfing board kit for assembling windsurfing boards of different types. The windsurfing boards of different types are adjustable in both length and width by using an intelligent combination of windsurfing portions, which when connected to each other can form windsurfing boards of three different types windsurfing boards, with markedly different sailing properties.

The second windsurfing board comprising all portions is suited for light winds conditions, and thus for beginners. The first windsurfing board comprising the base portion and elongated side portions, is suited for strong winds and may better suit modest surfer. The third windsurfing board comprising the base portion and having neither the elongated side portions 140 nor the second portion 104 is suited for even stronger winds and hence an advanced windsurfer.

In addition, the present disclosure has also presented a sail that is adjustable in sail area. The second sail portion may be used and is then connected to the first sailing portion, whereby the sailing area may is increased in size. One example of increase of the sail area is an increase from about 6 square meters to about 7 square meters in size.

Whereas the sail with the first sail portion is suited for strong or very strong winds or wind conditions, the larger sail portion is suited for light winds or wind conditions.

The present disclosure also presents combinations of windsurfing boards with sails. Since three different sizes of windsurfing boards and two different sizes of sails have been presented, the disclosure comprises a combination of 6 different windsurfing boards including a sail. Since the present disclosure presents multiple combinations of windsurfing boards and sails, a fully equipped windsurfing board may be easily tailored according to current wind conditions as well as to the skill of the surfer.

Figure 9:
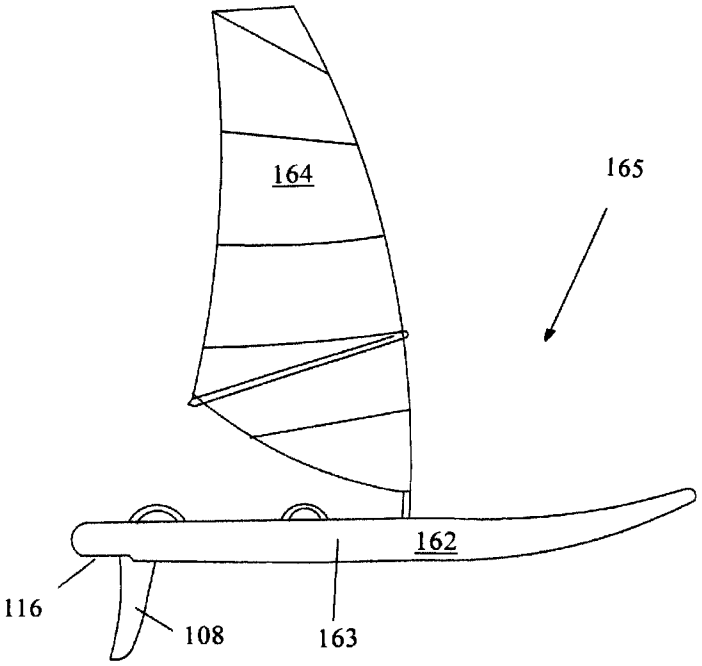
FIG. 9 presents a windsurfing board kit comprising a sail, according to embodiments of the present disclosure.

FIG. 9 illustrates an equipped windsurfing board 165 comprising a combination of one example of the windsurfing boards as presented above together with an example 164 of the sails as presented above. The windsurfing board itself 162 comprises a first tail fin 108 protruding from a bottom surface 163 of said windsurfing board 162. FIG. 9 also presents one cut-out 116 of the first portion 102, as earlier presented, for instance, in FIG. 5.

It may be mentioned that cut-outs formed out of a bottom side of a windsurfing board in general may be considered to provide stability benefits of a windsurfing board having a wider tail and planning in the water at an early stage. The cut-outs also provide a decreased water resistance due to the relatively narrower tail of windsurfing boards having cut-outs. A windsurfing board having cut-outs improves its speed potential and its maneuverability at high speeds. In addition, they may also reduce the tendency to suck into the water for wider windsurfing boards.

In addition to the advantages of the embodiments of this disclosure, as already presented in the text above, some embodiments also have the following advantages:

By providing a combination of three different boards for windsurfing, and two different windsurfing sails, it is enabled to tailor the choice of a windsurfing board according to weather conditions and the surfer's surfing skills.

In addition, a further advantage of the embodiments of the present disclosure is that the windsurfing board kit saves space and transportation cost, as compared to up to six separate complete windsurfing boards, and may therefore be considered to be environments friendly.

It is made clear that presented embodiments may well be combined forming new embodiments not explicitly described herein.

In the claims, the term "comprises/comprising" does not exclude the presence of other elements or steps. Additionally, although individual features may be included in separate claims, these may be combined, and the inclusion in different claims does not imply that a combination of features is not feasible and/or advantageous. In addition, singular references do not exclude a plurality. The terms "a", "an", "first", "second" etc do not preclude a plurality. Reference signs in the claims are provided merely as a clarifying example and shall not be construed as limiting the scope of the claims in any way.

Although this disclosure has been described above with reference to specific embodiment(s), it is not intended to be limited to the specific form set forth herein.

The invention claimed is:

1. A windsurfing board kit (100) for assembling different types of windsurfing boards, comprising:

a first portion (102) comprising a first bottom side (106) and a first tail fin (108) provided on said first bottom side (106), and a second portion (104) comprising a second bottom side (112) and a second fin (114) provided on said second bottom side (112), the second portion (104) being removably connectable to the first portion (102), wherein the first portion (102) is configured to constitute a first windsurfing board by itself, with the first portion (102) and the second portion (104) configured to constitute a second windsurfing board when connected together, with the first tail fin (108) configured to act as a center board of the second windsurfing board and the second fin (114) configured to act as a tail fin of the second windsurfing board, and the second portion (104) is substantially in the shape of a "U" and comprises a pair of extending elongated members (123) configured to be arranged along outer sides of the first portion (102) and encompass and mate with side rails (125) of the first portion (102) along inner surfaces of the elongated members (123).

2. The windsurfing board kit (100) according to claim 1, wherein the second windsurfing board has a bottom side that is formed by an entire or essentially the entire first bottom side (106) of the first portion (102) and the entire or essentially the entire second bottom side (112) of the second portion (104), when the first portion (102) is connected to the second portion (104).

3. The windsurfing board kit (100) according to claim 2, wherein the second portion (104) has a protruding member (120) configured to meet a connecting recess in the rear of the tail (110) of the first portion (102), the recess being directed essentially along, or at least parallel with, a centerline (A) of the second portion (104).

4. The windsurfing board kit (100) according to claim 1, wherein the second portion (104) has a protruding member (120) configured to meet a connecting recess in the rear of the tail (110) of the first portion (102), the recess being directed essentially along, or at least parallel with, a centerline (A) of the second portion (104).

5. A windsurfing board kit (165) for assembling different types of windsurfing boards, comprising a first portion (102) comprising a first bottom side (106) and a first tail fin (108) provided on said first bottom side (106), a second portion (104) comprising a second bottom side (112) and a second fin (114) provided on said second bottom side (112), the second portion (104) being removably connectable to the first portion (102), and a sail (164) configured for a windsurfing board, the sail comprising:

a first sail portion (148) having a mast leech (149), a rear leech (151), and one or more first batten pockets (152), and a second sail portion (150), having a front leech (154), a rear leech (156) and one or more second batten pockets (158), wherein the first portion (102) is configured to constitute a first windsurfing board by itself, with the first portion (102) and the second portion (104) configured to constitute a second windsurfing board when connected together, with the first tail fin (108) configured to act as a center board of the second windsurfing board and the second fin (114) configured to act as a tail fin of the second windsurfing board, the second sail portion (150) is removably connectable to the first sail portion (148) by at least one fastening member, and said one or more second batten pockets (158) are arranged to correspond to said one or more first batten pockets (152), enabling each first and second batten pocket (152, 158) to meet a first and a second end, respectively of a batten (160).

6. The windsurfing board kit (165) according to claim 5, when the second sail portion (150) is connected to the first sail portion (148), the sail further comprises one or more battens (160) of which one end of each one or more battens is inserted into one of the first batten pockets (152), and the other end of each one or more is inserted into one of the second batten pockets (158), and one or more battens are directed essentially perpendicular to the rear leech (151) of the first sail portion (148) as well as to the front leech (154) of the second sail portion (150).

7. The windsurfing board kit (165) according to claim 5, wherein the rear leech (156) of the second sail portion (150) ends at a clew (153) of the first sail portion (148), when the first sail portion (148) is connected to the second sail portion (150).

8. The windsurfing board kit (100) according to claim 1, wherein the first portion (102) comprises at least one through-hole (142) for fastening the first tail fin (108) thereto.

9. The windsurfing board kit (100) according to claim 8, wherein the first portion (102) comprises a pair of said through-holes (142) for fastening the first tail fin (108) thereto.

10. A windsurfing board kit (100,134, 136) for assembling different types of windsurfing boards, comprising:

a first portion (102) comprising a first bottom side (106) and a first tail fin (108) provided on said first bottom side (106), and a second portion (104) comprising a second bottom side (112) and a second fin (114) provided on said second bottom side (112), the second portion (104) being removably connectable to the first portion (102), wherein the first portion (102) is configured to constitute a first windsurfing board by itself, with the first portion (102) and the second portion (104) configured to constitute a second windsurfing board when connected together, with the first tail fin (108) configured to act as a center board of the second windsurfing board and the second fin (114) configured to act as a tail fin of the second windsurfing board, and the first portion (102) has at least one cut-out (116) from the bottom-side (106) at the tail (110) of said first portion.

11. The windsurfing board kit (100) according to claim 10, wherein the second portion (104) has a protruding element (118) protruding from the second portion (104), and said protruding element (118) is configured to meet the cutout (116) of the first portion (102), when the first portion (102) is connected to the second portion (104).

12. The windsurfing board kit (100) according to claim 11, wherein the second portion (104) has a protruding member (120) configured to meet a connecting recess in the rear of the tail (110) of the first portion (102), the recess being directed essentially along, or at least parallel with, a centerline (A) of the second portion (104).

13. The windsurfing board kit (100,134, 136) according to claim 12, wherein the first portion (102) comprises:

a base portion (138) comprising a third bottom side, a side rail (143) and the first tail fin (108) provided on said third bottom side, and one or two elongated side portions (140) that are removably connectable to the base portion (138) along said side rail (143).

14. The windsurfing board kit (100) according to claim 10, wherein the second portion (104) has a protruding member (120) configured to meet a connecting recess in the rear of the tail (110) of the first portion (102), the recess being directed essentially along, or at least parallel with, a centerline (A) of the second portion (104).

15. The windsurfing board kit (100,134, 136) according to claim 14, wherein the first portion (102) comprises:

a base portion (138) comprising a third bottom side, a side rail (143) and the first tail fin (108) provided on said third bottom side, and one or two elongated side portions (140) that are removably connectable to the base portion (138) along said side rail (143).

16. A windsurfing board kit (100,134, 136) for assembling different types of windsurfing boards, comprising:

a first portion (102) comprising a first bottom side (106) and a first tail fin (108) provided on said first bottom side (106), and a second portion (104) comprising a second bottom side (112) and a second fin (114) provided on said second bottom side (112), the second portion (104) being removably connectable to the first portion (102), wherein the first portion (102) is configured to constitute a first windsurfing board by itself, with the first portion (102) and the second portion (104) configured to constitute a second windsurfing board when connected together, with the first tail fin (108) configured to act as a center board of the second windsurfing board and the second fin (114) configured to act as a tail fin of the second windsurfing board, the first portion (102) comprises:

a base portion (138) comprising a third bottom side, a side rail (143) and the first tail fin (108) provided on said third bottom side, and one or two elongated side portions (140) that are removably connectable to the base portion (138) along said side rail (143).

* * * * *